US005622302A

United States Patent [19]

Ring

[11] Patent Number: 5,622,302

[45] Date of Patent: Apr. 22, 1997

[54] APPARATUS AND METHODS FOR BURSTING INTERSTACKED LONGITUDINALLY OFFSET FORM SETS FROM CONTINUOUS WEBS

[75] Inventor: Robert S. Ring, Rochester, N.H.

[73] Assignee: Moore Business Forms, Inc., Grand Island, N.Y.

[21] Appl. No.: 468,627

[22] Filed: Jun. 6, 1995

Related U.S. Application Data

[63] Continuation of Ser. No. 123,971, Sep. 21, 1993, abandoned.

[51] Int. Cl.[6] ..... B26F 3/02

[52] U.S. Cl. ..... 225/4; 225/100

[58] Field of Search ..... 225/2, 4, 100, 225/106

[56] References Cited

U.S. PATENT DOCUMENTS

| | | | |
|---|---|---|---|
| 4,261,497 | 4/1981 | Roetter et al. | 225/100 |
| 4,269,341 | 5/1981 | Polko | 225/100 |
| 4,284,221 | 8/1981 | Nagel et al. | 225/100 |
| 4,529,114 | 7/1985 | Casper et al. | 225/100 |
| 4,577,789 | 3/1986 | Hofmann et al. | 225/100 |
| 5,141,142 | 8/1992 | Ramsey | 225/100 |

*Primary Examiner*—Kenneth E. Peterson
*Assistant Examiner*—Raymond Woods
*Attorney, Agent, or Firm*—Nixon & Vanderhye P.C.

[57] ABSTRACT

Interstacked longitudinally offset form sets from continuous webs are fed through upstream low speed rollers and downstream rollers, with a breaker bar disposed between the roller pairs. The upper roller of the slow roller pair is mounted eccentrically to engage the webs between the upper and lower rollers of the slow roller pair once for each revolution of the upper roller. When a leading portion of one web enters the nip of the downstream rollers, the eccentrically mounted upper low speed roller engages the webs and the downstream roller pairs are rotated at a higher speed to create sufficient tension in the form between the pairs of rollers such that the form engages against the breaker blade to burst the form from the web. Upon bursting, the eccentric low speed roller disengages or opens relative to the webs and the leading portion of a form of the other web engages in the nip of the downstream roller pair whereupon the bursting of the form from the second web is accomplished.

5 Claims, 6 Drawing Sheets

20
18
38
40
28
22
24
3
2
1
5
4
W1
W2
70

APPARATUS AND METHODS FOR BURSTING INTERSTACKED LONGITUDINALLY OFFSET FORM SETS FROM CONTINUOUS WEBS

This is a continuation of application Ser. No. 08/123,971, filed Sep. 21, 1993, now abandoned.

FIELD OF THE INVENTION

The present invention relates to apparatus and methods for separating forms from interstacked form sets supplied from a continuous web and particularly to a forms burster capable of detaching overlapped, longitudinally offset forms.

Typical form bursters include a pair of low speed rollers between which a continuous web is passed enroute to a high speed roller pair. In U.S. Pat. No. 4,529,114 of common assignee herewith both the low and high speed roller pairs have at least one roller each in the form of an eccentric. Additionally, a breaker bar disposed between the high and low speed roller pairs likewise constitutes an eccentric. In that patent, the eccentric roller of each pair is typically spaced from the continuous web passing between the rollers. When a transverse perforation line aligns with the breaker bar, the eccentric rollers engage the web. With the high speed roller pair rotating at a speed faster than the speed of rotation of the low speed roller pair, the engagement of the web by both roller pairs tensions the web such that the form bursts frown the web along the transverse line of perforations adjacent the breaker bar eccentric. This arrangement, however, has not proved suitable for forms which are interstacked.

In interstacked forms, typically a single, continuous web is cut longitudinally in the direction of web travel and the discrete web portions are overlapped one over the other. The forms are also normally longitudinally offset one from the other such that generally, although not always, the transverse lines of perforations of one of the overlapped continuous webs lie medially between the transverse lines of perforations of the other web of the interstacked form sets.

BACKGROUND AND SUMMARY OF THE INVENTION

According to the present invention, a continuous form web is cut lengthwise in the direction of web travel and interstacked such that a pair of continuous webs overlap one another, with the forms of the overlapped webs being longitudinally offset one from the other. The interstacked continuous webs initially pass between a pair of slow rollers, one of which, preferably the upper roller, is mounted for movement toward and away from the lower roller, i.e., has an eccentric movement, to close and open the nip between the rollers. Subsequently, the interstacked webs pass into the nip of a pair of downstream rollers selectively driven at a speed comparable to the speed of the upstream slow rollers and a faster speed. A breaker bar is disposed between the pairs of rollers along the path of movement of the interstacked webs.

When the leading portion of one web passes through the downstream roller pair, and the transverse line of perforations of the one web is aligned substantially with the breaker bar, the eccentrically mounted low speed roller closes on the overlapped webs. Substantially simultaneously, the downstream rollers are also rotated at a higher speed relative to the slow speed rollers. The web between the roller pairs is thus tensioned against the breaker bar such that the breaker bar bursts the form along the transverse line of perforations. The downstream rollers quickly move the burst form from the bursting engine whereupon the leading portion of the other web is passed into the nip of the downstream rollers. Similar action occurs with the eccentric slow speed roller closing upon the overlapped webs to enable the form of the other web to be tensioned and burst. It will be appreciated that when the overlying web is engaged between the roller pairs, only the overlying web is tensioned and burst. Likewise, when the underlying web is engaged between the roller pairs, only the underlying web is tensioned and burst. Also, the nip between the rollers of the low speed roller pair is maintained open for the majority of each revolution. In this manner, upstream tractors normally feed the webs through the open nip whereby web pillowing or bubbling effects are avoided.

In a preferred embodiment according to the present invention, there is provided an apparatus for bursting interstacked, longitudinally offset, form sets from continuous webs, comprising a frame, a carriage carried by the frame for longitudinal sliding movement and a first pair of rollers carried by the carriage for rotation at a predetermined speed, the first pair of rollers being positioned to receive the interstacked form sets of the continuous webs between the rollers. At least one roller of the first pair of rollers is arranged to be intermittently moved into and out of engagement with the continuous interstacked web of form sets received between the rollers. A breaker blade is carried by the frame and a second pair of rollers is carried by the frame downstream from the first pair of rollers, the second pair of rollers alternately engaging leading portions of the interstacked form sets and being rotatable at a speed relative to the predetermined speed of the first pair of rollers to create a web tension sufficient to enable bursting of the web into individual forms when the one roller of the first pair of rollers engages the form sets.

In a further preferred embodiment according to the present invention, apparatus is provided for continuously alternately bursting at least first and second webs in an overlapped, longitudinally offset, arrangement of the webs, comprising a frame, first nipping elements carried by the frame and located to receive the webs therebetween at least one of the first nipping elements being selectively movable toward and away from another of the first nipping elements for alternately closing against and releasing the webs therebetween. Second nipping elements are carried by the frame for alternately engaging leading portions of each of the first and second webs, and means for moving second nipping elements when one of the first nipping elements is closed against the webs to create a web tension sufficient to burst individual forms from the one web.

In a still further preferred embodiment according to the present invention, there is provided a method for bursting interstacked longitudinally offset form sets from continuous webs thereof, comprising the steps of feeding the interstacked form sets between a first pair of rollers mounted for rotation at a predetermined speed, alternately feeding leading portions of the interstacked form sets through the nip of a second pair of rollers downstream from the first pair of rollers, disposing a breaker blade between the first pair of rollers and the second pair of rollers, intermittently moving one of the rollers of the first pair of rollers into and out of engagement with the continuous interstacked web of form sets between the rollers of the first pair thereof and rotating the second pair of rollers at a speed in excess of the speed of rotation of the first pair of rollers when one roller of the first pair thereof lies in engagement with the continuous interstacked web of form sets to create sufficient web tension between the first pair of rollers and the second pair of rollers to enable bursting of the web into individual forms.

Accordingly, it is a primary object of the present invention to provide novel and improved apparatus and methods for bursting interstacked longitudinally offset form sets from continuous webs.

DETAILED DESCRIPTION OF THE DRAWINGS

Figure 1:
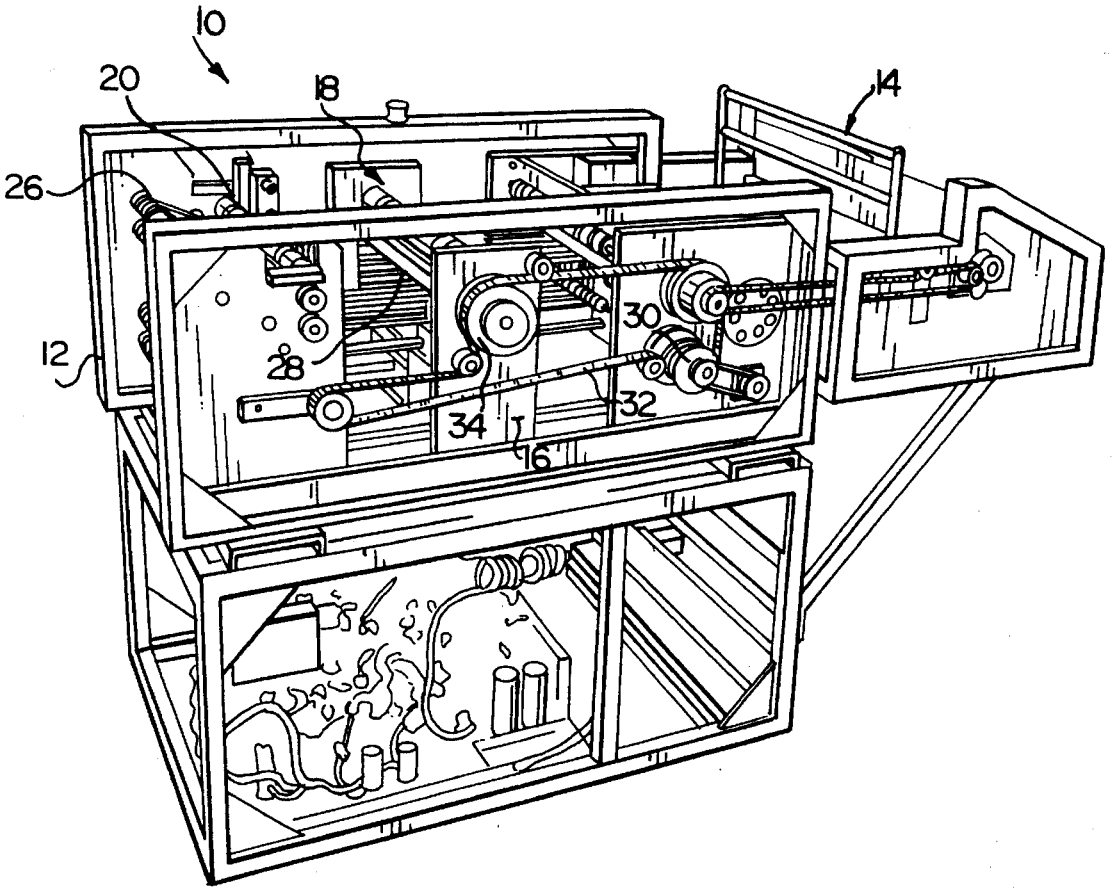
FIG. 1 is a perspective view of a bursting engine according to the present invention.
Figure 3:
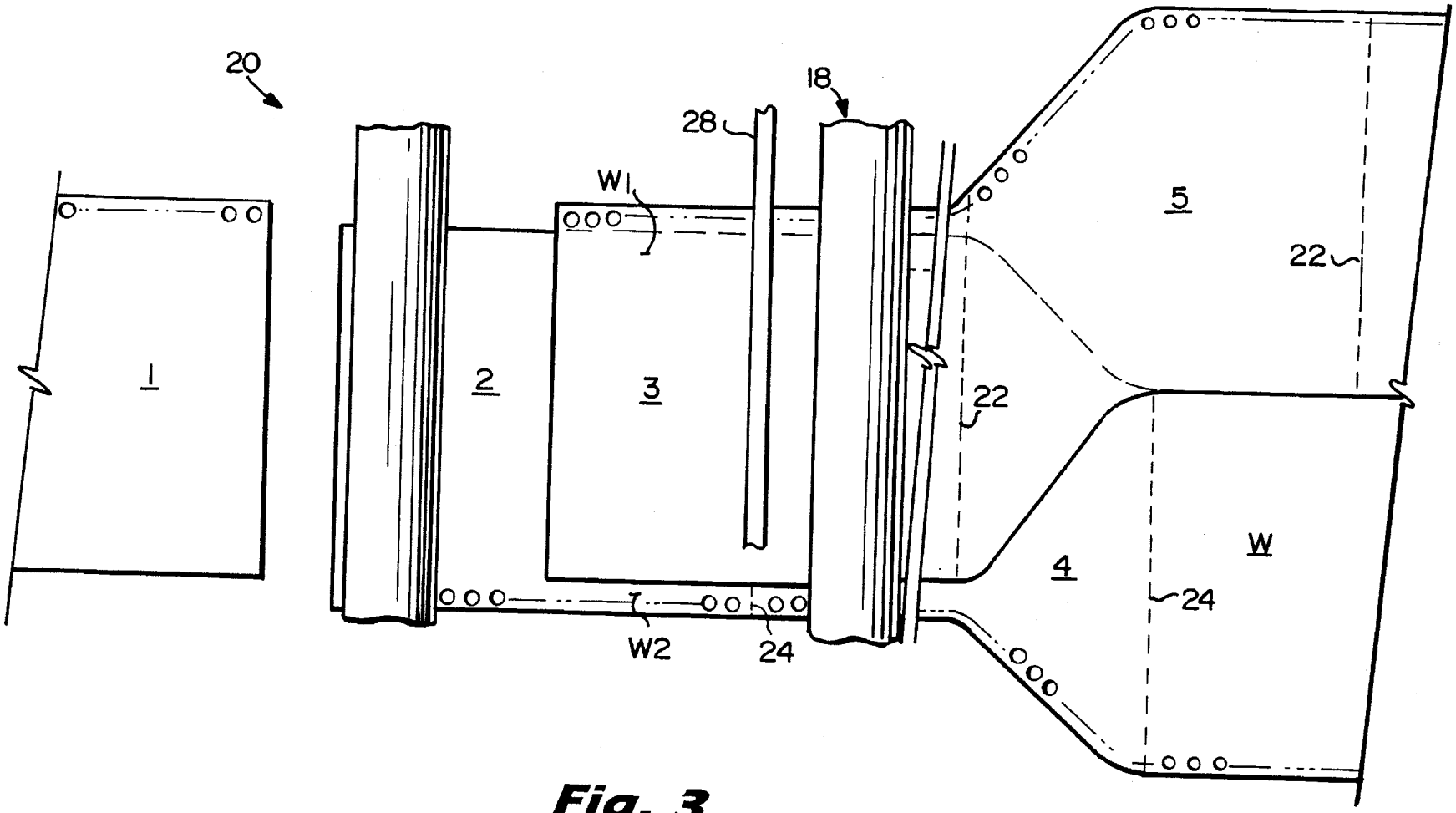
FIG. 3 is a fragmentary top plan view of the bursting engine of FIG. 1.

Referring now to FIG. 1, there is illustrated a form set bursting engine, generally designated 10, constructed in accordance with the present invention. Bursting engine 10 includes a frame 12 having an infeed portion 14 for receiving interstacked longitudinally offset form sets in continuous webs thereof, a carriage 16 mounting a pair of elements, preferably a pair of low speed rollers, generally designated 18 for selectively forming a nip, and a pair of downstream elements preferably a pair of rollers, generally designated 20, forming a continuous nip. The infeed 14 includes a slitter merger module, not specifically shown in detail, together with tractors and slitters, whereby a continuous web may be cut or slit longitudinally in the direction of web feed and the cut webs interstacked or overlapped one over the other. Modules of this type are well known and further description thereof is not believed necessary. Suffice to say and with reference to FIG. 3, a continuous web W is slit longitudinally such that the web W1 overlies the web W2 with a slight lateral offset. Additionally, it will be appreciated that the webs W1 and W2 are longitudinally offset one from the other a distance typically, though not necessarily, one-half the depth of the form, such that the transverse lines of perforations 22 and 24 of the interstacked webs W1 and W2, respectively, are longitudinally offset as illustrated in FIG. 3. Tractors, not shown, upstream of the roller pair 18 cooperate with tractor feed openings 23 and 25 in the webs W1 and W2, respectively, to advance the interstacked webs through the bursting engine.

As the interstacked webs pass between the upstream and downstream roller pairs 18 and 20, respectively, the forms of the webs are alternately burst to provide discrete forms exiting the bursting engine by delivery belts 26. As illustrated in FIG. 1, the carriage 16 is mounted on frame 12 for longitudinal sliding movement into adjusted positions, depending, for example, on the length of the forms being burst. Carriage 16 also carries a breaker blade 28 downstream of the low speed roller pair 18. A motor, not shown, operates a main drive pulley arrangement through a pulley 30, which drives a main driving belt 32 engaged about idler pulleys, as well as a lower slow speed roll drive pulley 34. The drive arrangement is such that the carriage 16 may be positioned at longitudinally adjusted positions along the frame.

Figure 2:
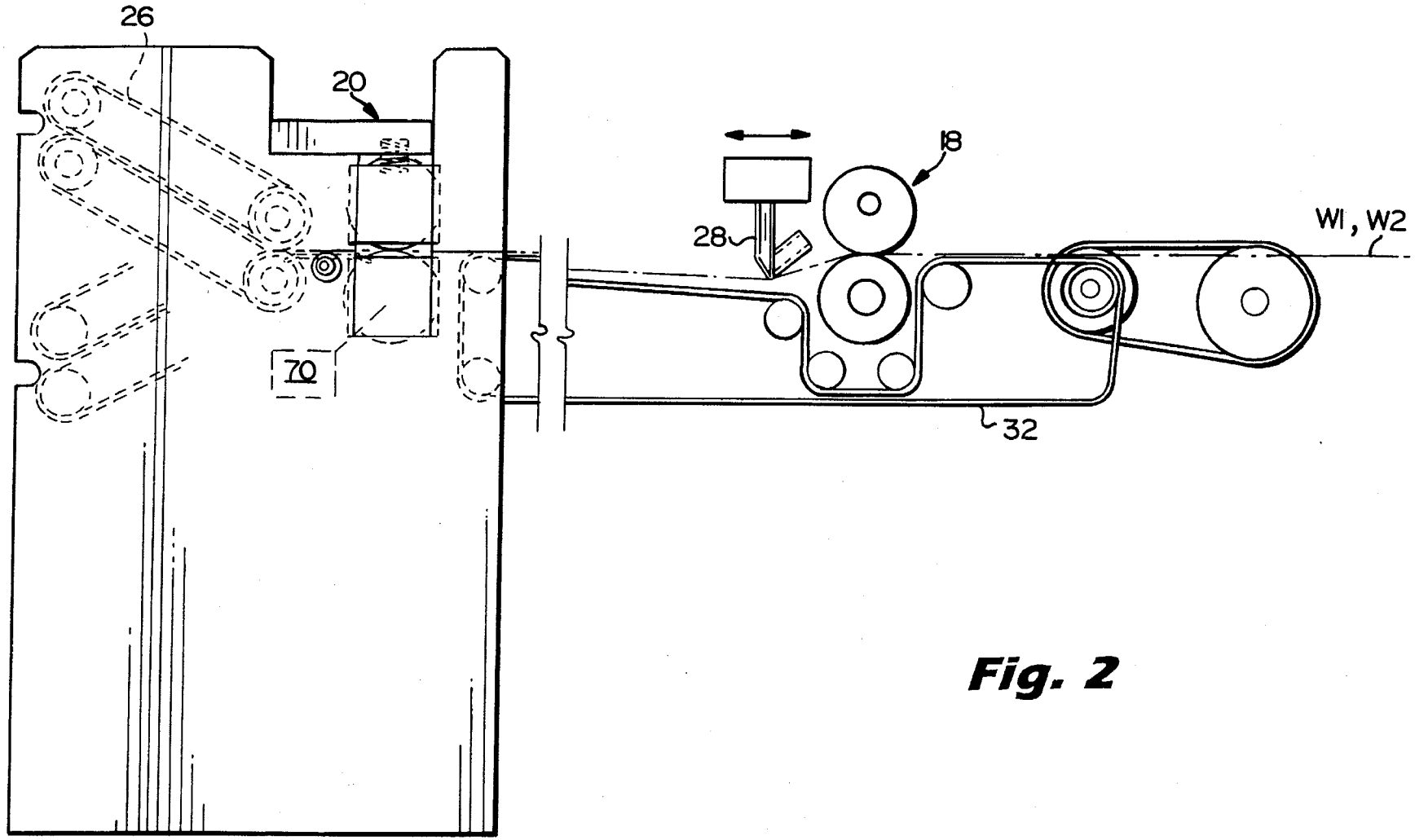
FIG. 2 is a side elevational view of the bursting engine with pans omitted for clarity.

Referring now to FIG. 2, the general arrangement of the low speed or upstream roller pair 18, the breaker bar 28, the downstream roller pair 20, the webs W1, W2 and the form delivery belts 26 is illustrated. The arrows in FIG. 2 represent the adjustable movement of the breaker bar 28 and low speed rollers 18 in the longitudinal direction relative to the webs W1 and W2 whereby forms of different lengths can be accommodated by the bursting engine 10.

Figure 4:
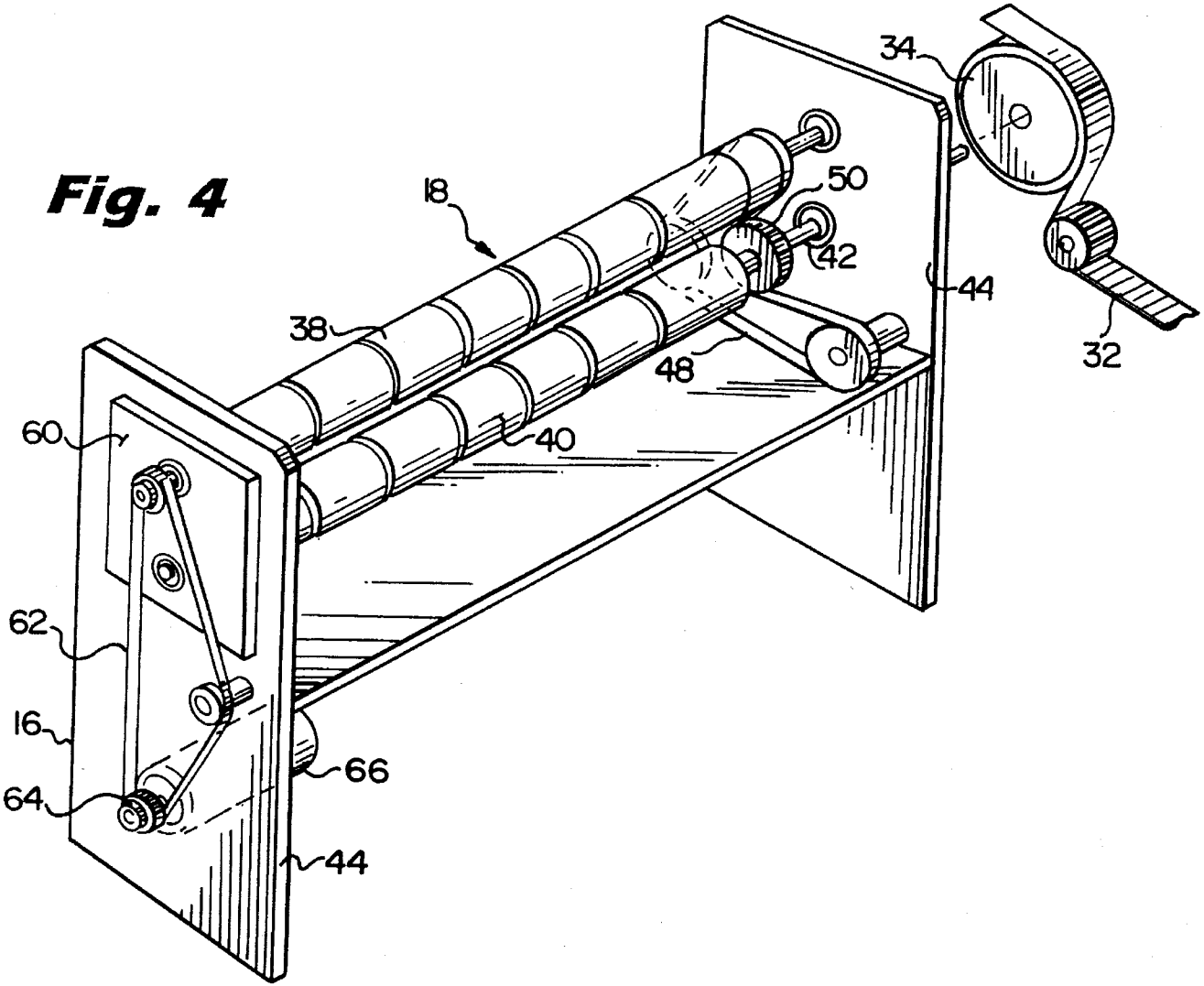
FIG. 4 is a perspective view of the slow speed rollers and their mounting.
Figure 5:
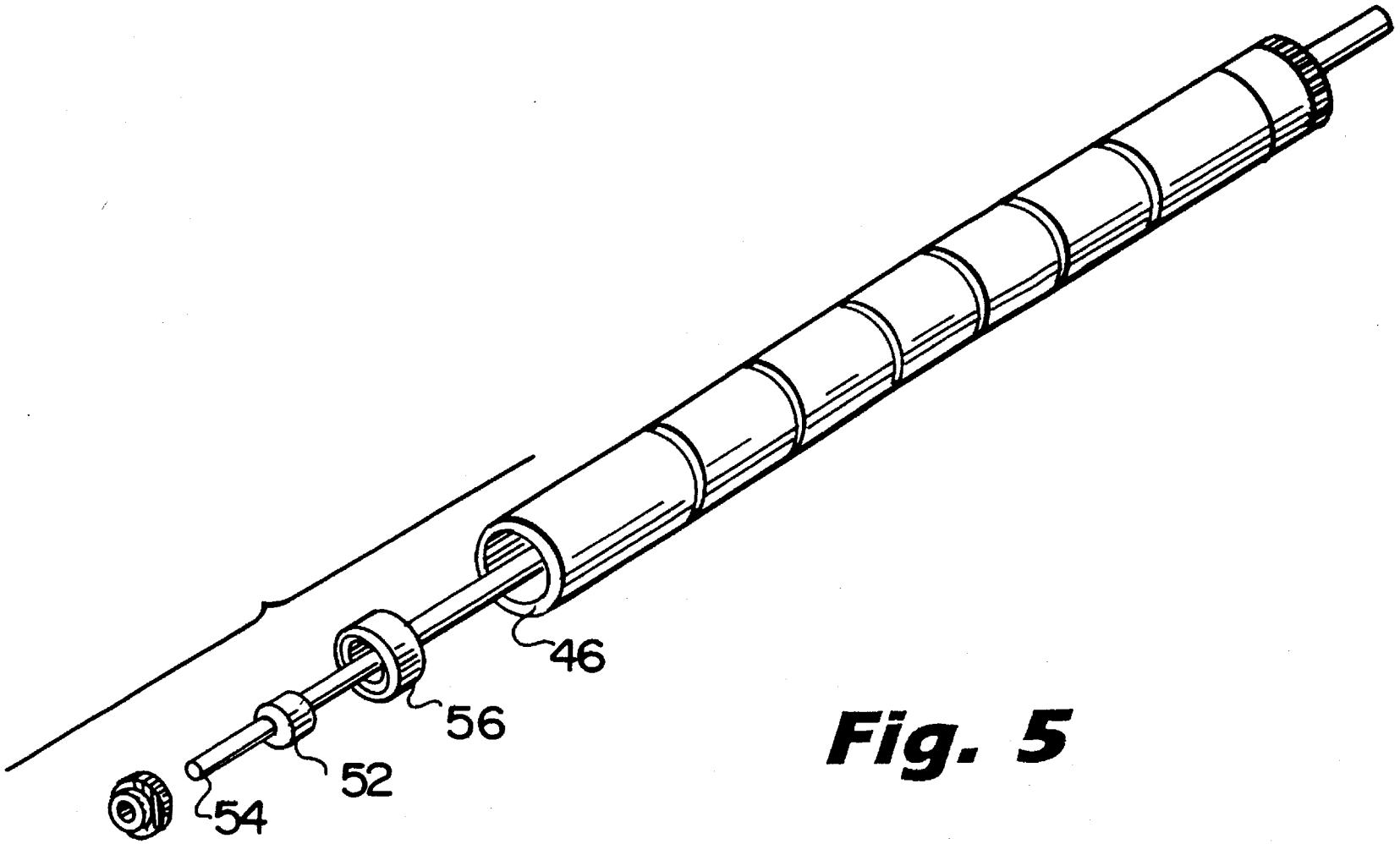
FIG. 5 is a perspective view of the upper slow speed roller.

Referring particularly to FIGS. 4 and 5, the carriage 16 for the low speed rolls 18 is illustrated. The low speed roller pair 18 includes upper and lower rollers 38 and. 40, respectively. The lower roller 40 is of solid construction and is mounted on a shaft 42, the journals of which are supported by bearings, not shown, mounted in side plates 44 of carriage 16. The lower roller 40 is driven by the drive pulley 34, in turn connected to the drive belt 32, previously described. Thus, the lower roller is driven from the main drive motor by the belt 32.

The upper slow speed roller 38 comprises an outer tube 46, as illustrated in FIG. 5, which is of the same diameter as the diameter of the lower roller 40. This upper roller 38 is driven at the same angular velocity as the lower roller by a timing belt drive 48 that connects the lower slow speed roller 40 via a pulley 50 and the upper slow speed roller 38. This timing drive is located on the inside of the side frame 44 of the carriage 16. With reference to FIG. 5, a pair of eccentrics 52, only one of which is illustrated, are mounted on opposite ends of the shaft 54 mounting the upper slow roller 38. The eccentric shaft 54 passes through the center of the upper slow roller tube 46. The tube 46, while fixed axially on shaft 54, is free to rotate about shaft 54. The tube 46 has needle bearings 56 at its opposite ends which ride on the eccentrics 52. The journals, not shown, for the eccentric shaft ends, pass through the slow roller side frames 44 and through adjustable bearing mounting plates 60 on each side of the carriage 16. On the outside of one frame 44, there is carried a timing belt 62 coupled to a timing pulley 64 mounted on the drive shaft of a servomotor 66 whereby shaft 54 is rotatable by the servomotor 66.

With the foregoing mounting of the slow speed rollers 18, it will be appreciated that the roller 38 is periodically raised and lowered relative to the lower roller 40 so that it comes into contact with the webs W1 and W2 passing between the upper and lower rollers 38 and 40, respectively, at only one instance for each 360° rotation of the servomotor shaft. More particularly, upper roller 38 is in contact with the webs W1 and W2 between the rolls only during the moment of a burst, i.e., the separation of a form from one of the continuous webs W1 and W2. The engagement of these rollers with the webs therebetween and the separation of the upper roller from the webs and lower roller is accomplished by signalling the servomotor to rotate through one 360° rotation per form depth being burst. As the servomotor shaft rotates, the eccentric shaft 54 is rotated about its centerline axis via the timing belt 62 mounted between the servomotor shaft and the end journal of the eccentric shaft. Thus, for only a short interval of rotation, the upper roller 38 engages the web at the nip of rollers 38 and 40, the upper roller being normally spaced from the lower roller to maintain the nip open. A new independent motor 70 is coupled to the downstream rollers 20 such that the rollers 20 can be driven at two speeds, a first speed when bursting a non-interstacked single continuous web and a second higher speed for bursting the forms from laterally offset interstacked webs. Also, carriage 16 and breaker blade 28 carried thereby are movable longitudinally into selected adjusted positions vis-a-vis the rollers 20 such that the bursting engine 10 may accommodate forms of different depths.

Figures 6A, 6B, 6C, 6D:
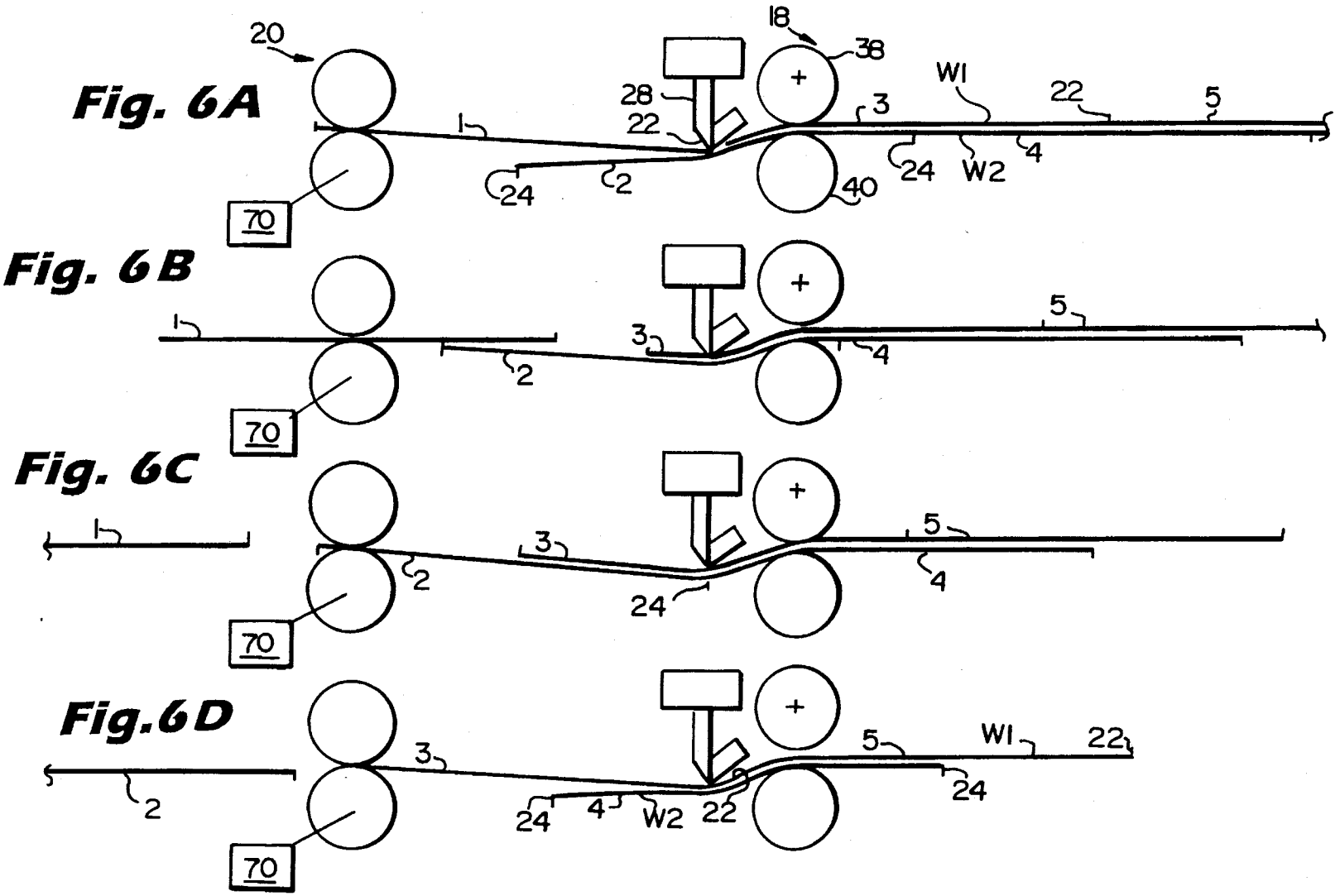
FIGS. 6A–6D are schematic illustrations of the manner of bursting interstacked longitudinally offset form sets from continuous webs in accordance with the present invention.

Referring now to FIGS. 6A–6D, the operation of the bursting engine in relation to the interstacked form webs will now be described. Referring to FIG. 6A, the interstacked continuous webs W1 and W2 are illustrated with the transverse perforation lines indicated at 22 and 24, respectively. With the first form 1 having a leading portion extending between the downstream rollers 20, i.e., passing into and through the nip of the rollers, the bursting engine is set up such that the breaker bar 28 substantially overlies the transverse line of perforations 22 of the web W1. FIG. 6A illustrates the setup of the engine as the first form 1 is burst along the transverse perforation line 22 below the breaker bar 28. It will be seen that the eccentric upper roller 38 has closed the nip with lower roller 40, and for a brief interval of rotation, presses both webs W1 and W2 against the lower roller 40. To separate or burst form 1 from web W1. motor 70 operates to increase the speed of rotation of the downstream rollers 20 to a speed greater than the speed of rotation of the low speed rollers 18 while the webs W1 and W2 lie in the closed nip of the roller pair 18. This higher speed creates sufficient tension on the form 1 between the roller pairs 18 and 20 such that form 1 bursts along the transverse line of perforations 22 substantially underlying the breaker blade 28. Upon bursting and as illustrated in FIG. 6B, the first form 1 is rapidly conveyed from between the rollers 20 onto the delivery belts 26.

The webs W1 and W2 are advanced by the tractor feeds, not shown, upstream of the slow roller pair 18. Thus, as illustrated in FIG. 6B, the first form 1 is displaced from between the downstream rollers 20, while the second form 2 is advanced by the upstream tractor feeds. Additionally, the upper roller 38 has been rotated by the timing pulley 62 into a position out of engagement with webs W1 and W2 thus opening the nip between rollers 38 and 40. It will also be appreciated that there is a conveyor, not shown, underlying the webs W1 and W2 between the upstream and downstream roller pairs 18 and 20 for directing the webs into the nip of roller pair 20. Thus, as the webs W1 and W2 continue to advance, the leading portion of form 2 of web W2 enters the nip of the downstream rollers 20. When the transverse line of perforations 24 of the web W2 are substantially aligned below the breaker blade 28 with form 3 of web W1 intervening between those transverse line of perforations and the breaker blade, the upper slow speed roller 38 is driven by the timing belt 62 into engagement with the webs W1 and W2 to once again close the nip between rollers 38 and 40. Simultaneously, motor 70 operates to increase the speed of rotation of the downstream rollers 20, to tension form 2 against breaker blade 28 and burst the form along its transverse line of perforations 24. As illustrated in FIG. 6D, and immediately after form 2 burst from web W2 is advanced to the delivery belts by the downstream rollers, the nip between rollers 38 and 40 again opens with respect to the webs W1 and W2 between it and the webs continue to advance.

It will be appreciated from the foregoing description that the forms are burst alternately from the superposed or overlapping webs W1 and W2 with the forms being out of phase lengthwise of the bursting engine, preferably by a distance equal to one-half the form depth. This invention also enables the feeding and bursting of non-interstacked single wide continuous webs of forms.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A method for bursting interstacked longitudinally offset form sets from continuous webs thereof, comprising the steps of:

feeding the interstacked form sets between a first pair of normally spaced apart rollers mounted for rotation at a predetermined speed such that at least one roller is normally spaced from engagement with the webs between the first pair of rollers substantially throughout the entire rotation of said one roller;

alternately feeding leading portions of the interstacked form sets through the nip of a second pair of rollers downstream from said first pair of rollers;

continuously rotating said second pair of rollers at a speed corresponding to the speed of rotation of said first pair of rollers to advance the form sets through said second pair of rollers;

disposing a breaker blade between said first pair of rollers and said second pair of rollers;

intermittently moving said one roller of said first pair of rollers into and out of engagement with the continuous webs of interstacked form sets between the rollers of said first pair thereof such that said one roller engages the webs between the first pair for rollers for only a short interval of rotation of said one roller; and periodically increasing the speed of rotation of said second pair of rollers to a speed in excess of the speed of rotation of said first pair of rollers when said one roller of said first pair thereof lies in engagement with the continuous webs of interstacked form sets to create sufficient web tension between said first pair of rollers and said second pair of rollers during said short interval of rotation of said one roller to enable bursting of the webs into individual forms.

2. A method according to claim 1 including continuously engaging said second pair of rollers with one or another of the leading portions of the interstacked form sets.

3. A method according to claim 1 including alternately engaging the one roller of said first pair of rollers with the form sets while continuously engaging said second pair of rollers with one or another of the leading portions of the interstacked form sets.

4. A method according to claim 1 including continuously engaging said second pair of rollers with one or another of the leading portions of the interstacked form sets, rotating said second pair of rollers at a speed comparable to the speed of rotation of said first pair of rollers when said one roller of said first pair thereof lies out of engagement with the continuous webs of interstacked form sets.

5. A method according to claim 1 including alternately engaging the one roller of said first pair of rollers with the form sets while continuously engaging said second pair of rollers with one or another of the leading portions of the interstacked form sets, and rotating said second pair of rollers at a speed comparable to the speed of rotation of said first pair of rollers when said one roller of said first pair thereof lies out of engagement with the continuous webs of interstacked form sets.

* * * * *